US012459696B2

(12) United States Patent
Choi

(10) Patent No.: US 12,459,696 B2
(45) Date of Patent: Nov. 4, 2025

(54) HAND-HELD WRAPPING DEVICE

(71) Applicant: Yoon Bae Choi, Gyeonggi-do (KR)

(72) Inventor: Yoon Bae Choi, Gyeonggi-do (KR)

( * ) Notice: Subject to any disclaimer, the term of this patent is extended or adjusted under 35 U.S.C. 154(b) by 135 days.

(21) Appl. No.: 18/522,400

(22) Filed: Nov. 29, 2023

(65) Prior Publication Data

US 2024/0308712 A1 Sep. 19, 2024

(30) Foreign Application Priority Data

Mar. 16, 2023 (KR) ..... 10-2023-0034596

(51) Int. Cl.
*B65B 67/08* (2006.01)
*B65H 16/00* (2006.01)

(52) U.S. Cl.
CPC ..... *B65B 67/085* (2013.01); *B65H 16/005* (2013.01); *B65H 2701/1944* (2013.01)

(58) Field of Classification Search
None
See application file for complete search history.

(56) References Cited

U.S. PATENT DOCUMENTS 4,484,717 A * 11/1984 Goldstein ..... B65H 75/30 242/588
4,530,473 A * 7/1985 Parry ..... B65B 67/085 242/422.4
6,241,176 B1 * 6/2001 McEntee ..... B65H 75/14 242/588.2
7,543,426 B1 * 6/2009 Phero ..... B65B 67/085 156/577
9,598,196 B2 * 3/2017 Choi ..... B65B 67/085
10,023,342 B1 * 7/2018 Malin ..... B65B 11/585
11,772,929 B1 * 10/2023 Langeman ..... B65H 75/08 242/588.2
2007/0151208 A1 * 7/2007 Huang ..... B65B 67/085 53/390
2013/0074446 A1 * 3/2013 Windheuser ..... B65B 67/085 53/203
2014/0116004 A1 * 5/2014 Pace ..... B65H 75/406 53/390
2015/0166285 A1 * 6/2015 Stanton ..... B65B 67/085 242/422
2019/0100341 A1 * 4/2019 Goldman ..... B65B 67/085
2023/0356970 A1 * 11/2023 Kohn ..... B65H 23/06

FOREIGN PATENT DOCUMENTS

DE 20 2016 101 956 * 4/2016
KR 101227018 1/2013

* cited by examiner

*Primary Examiner* — William A. Rivera
(74) *Attorney, Agent, or Firm* — IPLA P.A.

(57) ABSTRACT

A manual wrapping apparatus includes: a wrap roll including wrap which is wound around an outer surface of a paper tube; a support rod which has a fixed grip portion formed at one end and on which the wrap roll is mounted at the other end portion; a first rotary grip portion that is rotatably provided on one side of an outer surface of the support bar; a first support portion that is fixed and coupled to the one side of the outer surface of the support rod; a second support portion that is detachably coupled to the one side of the outer surface of the support rod corresponding to an outer end of the wrap roll and is supported by the outer end of the wrap roll; and a second rotary grip portion that is rotatably coupled to one side of the second support portion.

4 Claims, 9 Drawing Sheets

HAND-HELD WRAPPING DEVICE

BACKGROUND

The present invention relates to a manual wrapping apparatus, and more specifically, to a manual wrapping apparatus that not only prevents problems of wrapping with a worker's glove caught into the wrapping in a process of wrapping multiple layers of packs and packaging boxes stacked on a pallet or a wrap roll being released from a fixing state thereof but also enables maintenance costs to be significantly reduced by improving a structure of a manual wrapping apparatus.

Among the products manufactured generally in a production line product, the product manufactured in pack units and the product packed in a box are shipped in a state that a plurality of packs is stacked in multiple layers on a pallet and the boxes is stacked in multiple layers respectively.

At this time, in order to prevent the packs stacked in multiple layers and the contents contained in the packing box from being damaged owing to the impact generated during the loading and the transport of the vehicle, the outsides thereof are covered with the wrap.

In the meantime, conventionally, the operation of wrapping the outside of the packs stacked in multiple layers on the pallet and the boxes stacked in multiple layers is manually conducted by the operator. At this time, in a state that the operator holds the end portion of a branch pipe of the wrap roll having a wound wrap with both hands, a proper tension is added to the wound wrap of the wrap roll, so that the wrapping operation is performed by means of the gripping power using both hands of the operator.

However, in the above method, in the course of wrapping the packs stacked in multiple layers on the pallet and the boxes stacked in multiple layers from the upper end portion and to the lower end portion thereof or from the lower end portion and to the upper end portion thereof by means of the operator, since the operator have to bend and stretch his or her body repeatedly, it can cause a problem that put a strain on the operator's body over a long period of time.

For the above reasons, the present applicant had applied for and obtained Korean Patent Registration No. 10-1227018, which is a technology related to a manual wrapping apparatus in that the operator does not have to bend his or her body during the wrapping operation but can carry out the operation while maintaining a standing position.

As shown in FIG. 1, the manual wrapping apparatus of Korean Patent Registration No. 10-1227018 includes a wrap roll (40') having a wrap (40*b*') wound around an outer surface of a branch pipe (40*a*'); a support rod (10') having one end portion for providing a fixing grip portion (11') thereon and the other end portion coupled to the wrap roll (40'); a rotating grip portion (30') rotatably coupled on one side of an outer surface of the support rod (10'); and a fixing member (50') having first and second supporting members (50*a*' and 50*b*') for supporting both end portions of the wrap roll (40') on the support rod (10') and coupled to one side of an outer surface of the support rod (10') corresponding to both ends of the wrap roll (40') and a separation preventing member (50*c*') for preventing the separation of the second supporting member (50*b*') coupled to the other end portion of the support rod (10').

In the manual wrapping apparatus of Korean Patent Registration No. 10-1227018 as described above, in a state that the operator holds the rotating grip portion (30') with one hand and the fixing grip portion (11') with the other hand, the wrapping operation is performed by rotating the support rod (10') while adjusting the gripping power applied to the fixing grip portion (11') so that the appropriate tension is applied to the wrap. Therefore, the operator can carry out the wrapping operation while maintaining a standing position.

However, in the manual wrapping apparatus of the above-mentioned Korean Patent Registration No. 10-1227018, if the operator performs the wrapping operation while wearing gloves, the gloves worn on the operator's hand holding the fixing grip portion (11') may become rolled up as the fixing grip portion (11') rotates, causing a problem in which proper wrapping operation cannot be performed.

In addition, in the manual wrapping apparatus of the above-mentioned Korean Patent Registration No. 10-1227018, in a state that the operator holds the rotating grip portion (30') with one hand and the separation preventing member (50*c*') with the other hand, the wrapping operation can be performed by rotating the support rod (10') while adjusting the gripping power applied to the separation preventing member (50*c*') so that the appropriate tension is applied to the wrap. Even in this case, the gloves worn on the operator's hand holding the separation preventing member (50*c*') may become rolled up as the separation preventing member (50*c*') rotates, causing a problem in which proper wrapping operation cannot be performed.

Additionally, during the wrapping operation, the separation preventing member (50*c*') becomes loose, causing the wrap roll (40') to become unfixed.

In addition, in the manual wrapping apparatus of the above-mentioned Korean Patent Registration No. 10-1227018, since the other end of the support rod (10'), to which the wrap roll is coupled, frequently comes into contact with the ground during the wrapping process, the other end of the support rod (10') may be worn when used for a long time. In this case, there is a problem in that the entire support rod (10') has to be replaced, resulting in a significant increase in maintenance costs.

Patent Literature 1: Korean Patent Registration No. 10-1227018 (Jan. 28, 2013; Manual wrapping apparatus)

SUMMARY OF THE INVENTION

The present invention is made to solve the problems described above, and an object of the present invention is to provide a manual wrapping apparatus that not only prevents problems of wrapping with a worker's glove caught into the wrapping in a process of wrapping multiple layers of packs and packaging boxes stacked on a pallet or a wrap roll being released from a fixing state thereof but also enables maintenance costs to be significantly reduced by improving a structure of a manual wrapping apparatus.

According to one aspect of the present invention so as to accomplish these objects, there is provided to a manual wrapping apparatus including: a wrap roll including wrap which is wound around an outer surface of a paper tube; a support rod which has a fixed grip portion formed at one end and on which the wrap roll is mounted at the other end portion; a first rotary grip portion that is rotatably provided on one side of an outer surface of the support bar; a first support portion that is fixed and coupled to the one side of the outer surface of the support rod corresponding to an inner end of the wrap roll and is supported by the inner end of the wrap roll; a second support portion that is detachably coupled to the one side of the outer surface of the support rod corresponding to an outer end of the wrap roll and is supported by the outer end of the wrap roll; and a second rotary grip portion that is rotatably coupled to one side of the second support portion.

Here, the second rotary grip portion includes a rotary body that is rotatably coupled to the one side of the second support portion; and a protection cap that extends from one side of the rotary body toward the other end portion of the support rod and covers the other end portion of the support rod.

In addition, the rotary body has a grip groove formed at the other side of the rotary body, the grip groove being sunk toward the one end portion of the support rod.

Moreover, the protection cap has a grip hole which is formed at one side of the protection cap to restrict rotational movement of the support rod.

Furthermore, the first support portion and the second support portion have, respectively, a first support body and a second support body which are supported by the inner end and outer end of the wrap roll, respectively, and first insertion parts and second insertion parts which are formed to project from the first support body and the second support body toward the wrap roll and are inserted into the paper tube of the wrap roll; and the first insertion parts and the second insertion parts are formed at multiple positions to be separated at regular intervals along an outer direction from centers of the first support body and the second support body.

BRIEF DESCRIPTION OF THE DRAWINGS

The above and other objects, features and advantages of the present invention will be more apparent from the following detailed description taken in conjunction with the accompanying drawings, in which.

Figure 1:
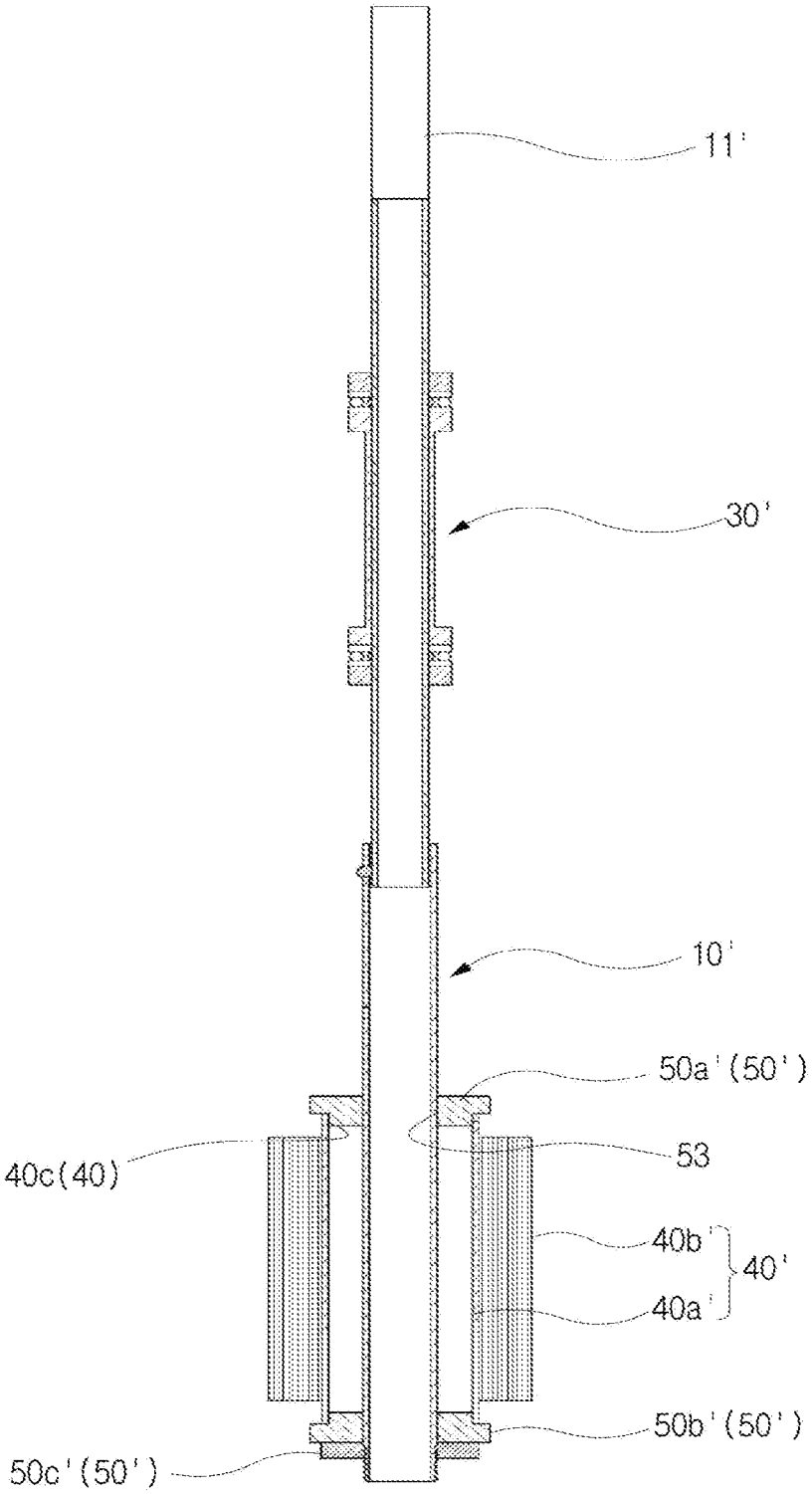
FIG. 1 Prior Art
FIG. 1 is a schematic cross-sectional view of a conventional manual wrapping apparatus.

1: manual wrapping apparatus
10: wrap roll
10: manual wrapping apparatus
11: paper tube
11*a*: insertion hole
12: wrap
20: support rod
21: support bar
21*a*: fixed grip portion
22: fastening bar
22*a*: male thread
30: first rotary grip portion
31: rotary member
32: support piece
33: bearing member
40: first support portion
41: first support body
41*a*: first support plate
41*b*: fixed tube body
42: first insertion part
50: second support portion
51: second support body
51*a*: second support plate
51*aa*: fastening hole
51*ab*: female thread
51*b*: extension tube body
51*ba*: first lock step
52: second insertion part
60: second rotary grip portion
61: rotary body
61*a*: rotary plate
61*aa*: through-hole
61*ab*: grip groove
61*b*: rotary tube body
61*ba*: second lock step
62: protection cap
62*a*: grip hole

DETAILED DESCRIPTION OF THE PREFERRED EMBODIMENT

Hereafter, a preferred embodiment according to the present disclosure are described in detail with reference to the accompanying drawings. The same reference numbers are given to the same or corresponding components regardless of drawing codes. The detailed description about the prior related technology will also be omitted when it is judged to blur the gist of this invention in explaining this invention.

Figure 2:
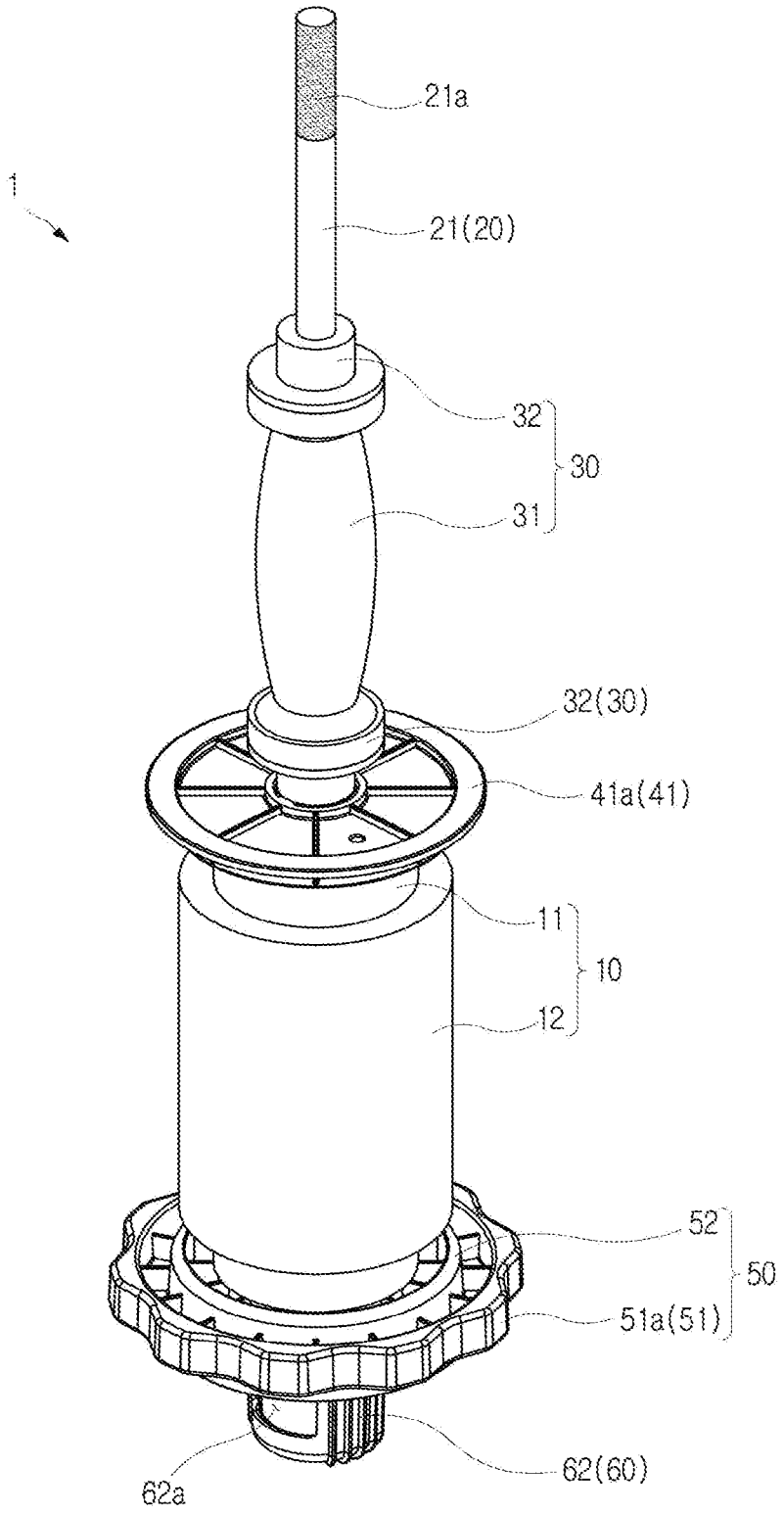
FIG. 2 is a perspective view of a manual wrapping apparatus according to an embodiment of the present invention.
Figure 3:
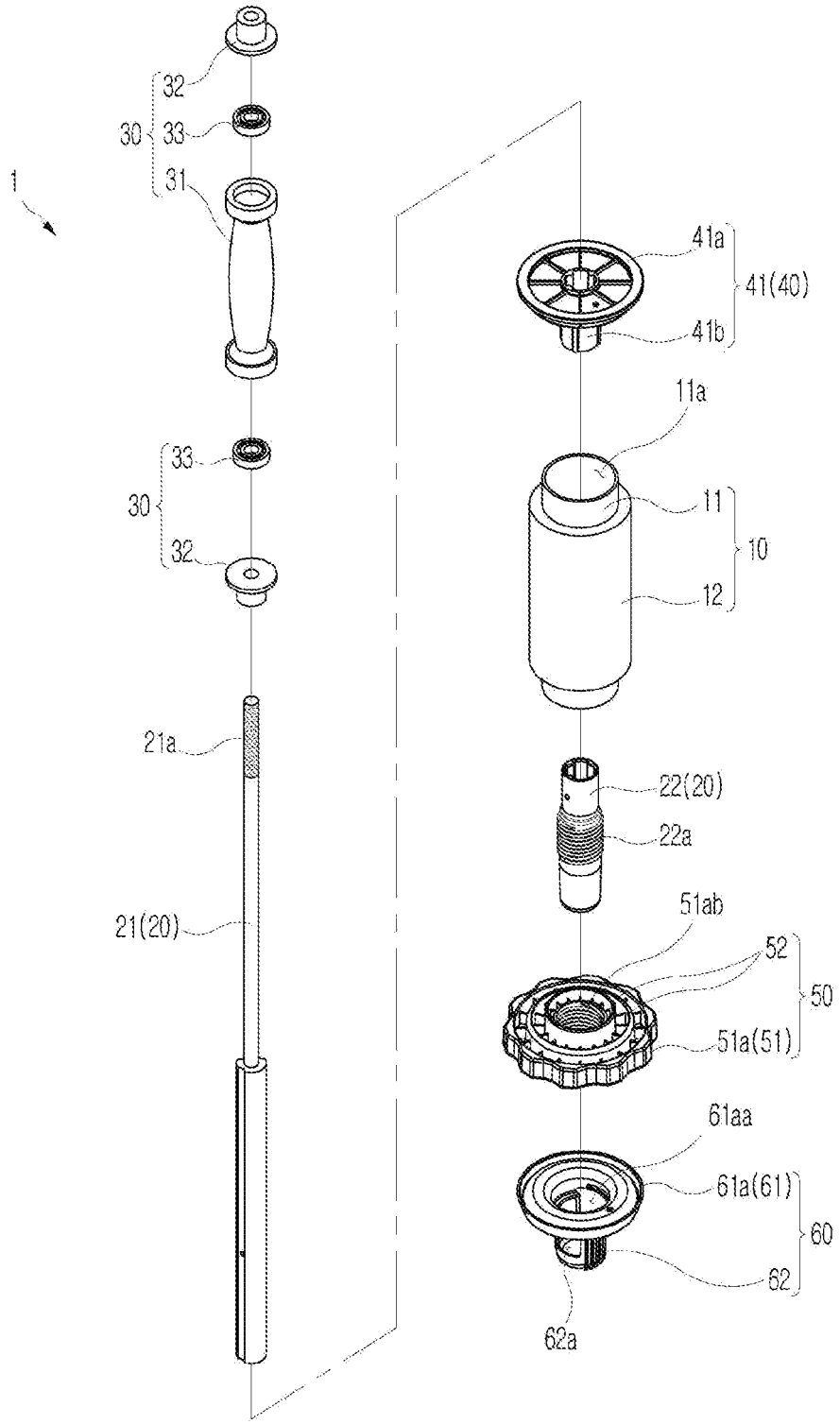
FIG. 3 is an exploded perspective view of the manual wrapping apparatus according to the embodiment of the present invention from above.
Figure 4:
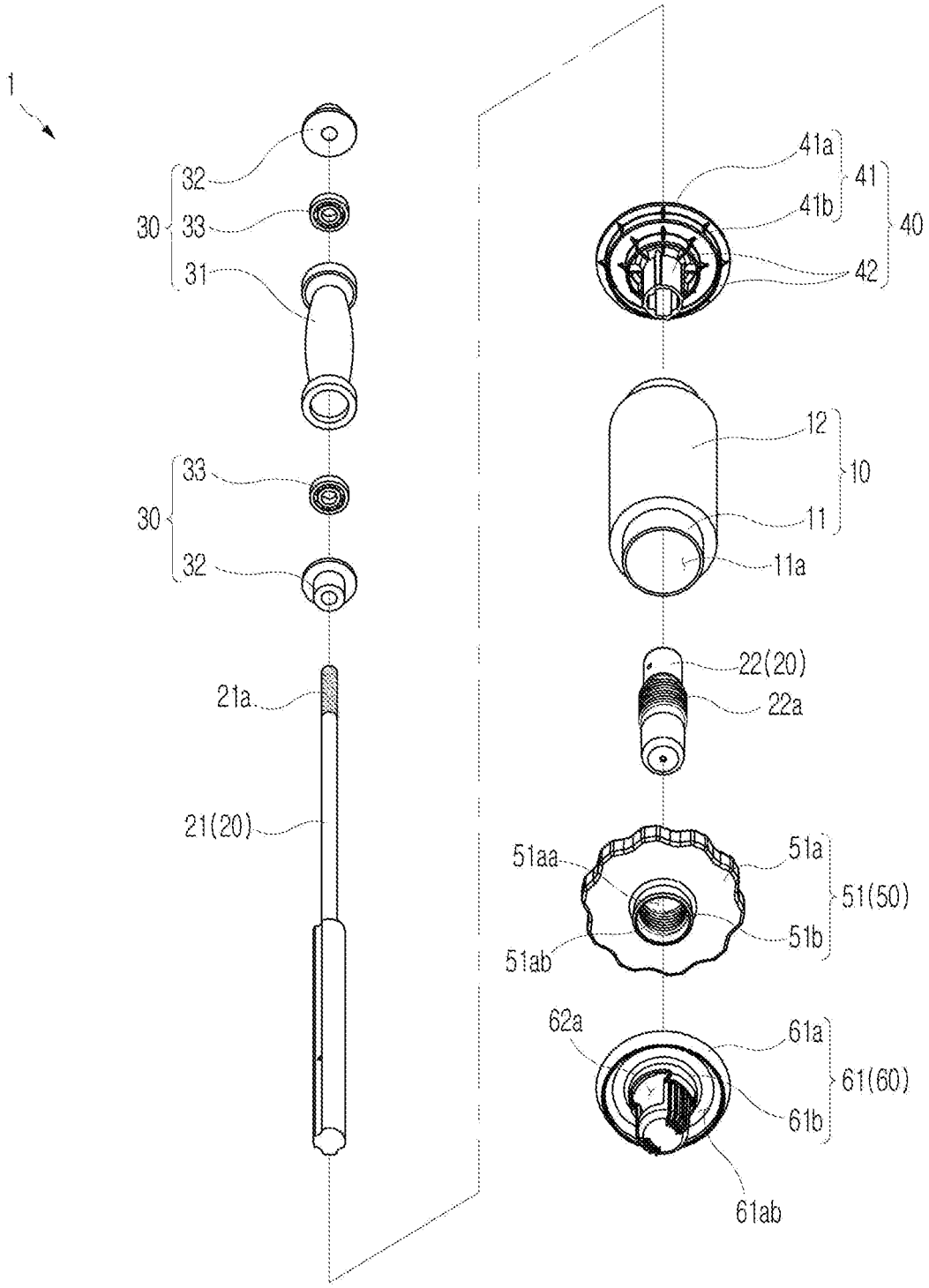
FIG. 4 is an exploded perspective view of the manual wrapping apparatus according to the embodiment of the present invention from below.
Figure 5:
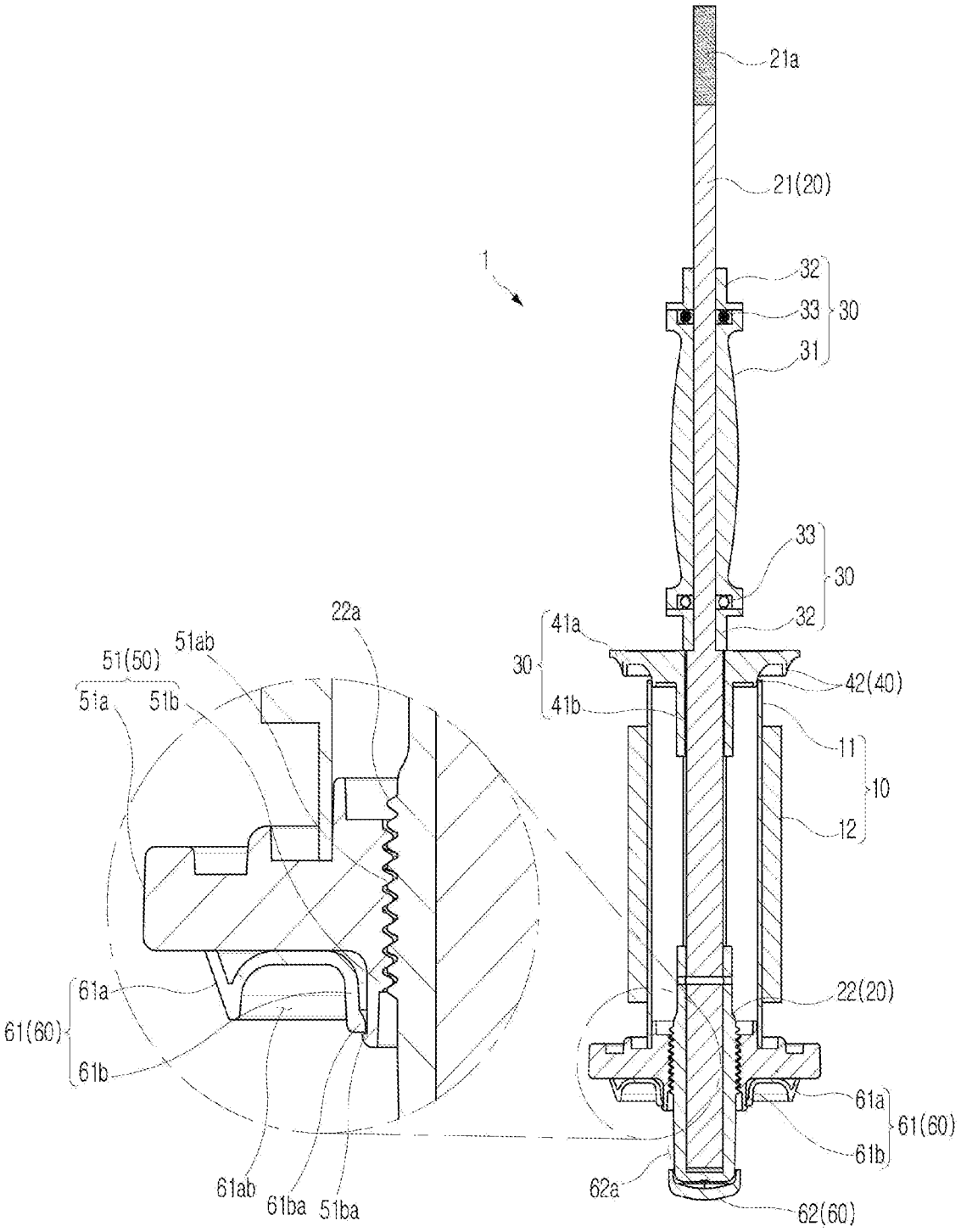
FIG. 5 is a cross-sectional view of the manual wrapping apparatus according to the embodiment of the present invention.

FIG. 2 is a perspective view of a manual wrapping apparatus according to an embodiment of the present invention. FIG. 3 is an exploded perspective view of the manual wrapping apparatus according to the embodiment of the present invention from above. FIG. 4 is an exploded perspective view of the manual wrapping apparatus according to the embodiment of the present invention from below. FIG. 5 is a cross-sectional view of the manual wrapping apparatus according to the embodiment of the present invention from above.

With reference to FIGS. 2 to 5, a manual wrapping apparatus (1) according to the embodiment of the present invention is configured to include a wrap roll (10), a support rod (20), a first rotary grip portion (30), and a first support portion (40), a second support portion (50), and a second rotary grip portion (60).

The wrap roll (10) has a structure in which several layers of wrap (12) are wound around an outer surface of a tube body made of a thick paper material, that is, a paper tube (11), and an insertion hole (11*a*) formed in the paper tube (11) provides a space where first insertion parts (42) and second insertion parts (52) of the first support portion (40) and the second support portion (50), which will be described below, are coupled.

The support rod (20) includes a support bar (21) that is formed in a shape of a circular bar with a certain length and has a fixed grip portion (21*a*) at one end portion thereof to provide a grip region for a worker, and a fastening bar (22) that has a tubular shape opened at one end, is fixed and coupled to the other end portion of the support bar (21), and has a male thread (22*a*) formed on an outer circumferential surface of the fastening bar for detachably fastening the second support portion (50) to be described later.

In the embodiment, for convenience of description, a structure in which the support bar (21) is integrally formed is illustrated as an example, but the present invention is not limited thereto, and the support bar (21) of the present invention can be formed in a structure in which a length can be adjusted while two divided support bars slide to be coupled to each other.

The first rotary grip portion (30) is rotatably coupled to an outer circumferential surface of the support bar (21) corresponding to an inner side of the fixed grip portion (21*a*) to provide a gripping region to a worker and includes a rotary member (31), support pieces (32), and bearing members (33).

The rotary member (31) has expanded diameter portions (31*a*) which have a round tubular shape and have a diameter increasing at both end portions of the rotary member, and the rotary member is disposed at the outer circumferential surface of the support rod (20) corresponding to an inner side of the fixed grip portion (21*a*).

The support pieces (32) are fixed and coupled to the outer circumferential surface of the support rod (20) corresponding to both ends of the rotary member (31) and support both ends of the rotary member (31), thereby preventing the rotary member (31) from being separated from the support rod (20).

The bearing members (33) are provided on the outer circumferential surface of the support rod (20) corresponding to the expanded diameter portions (31*a*) of the rotary member (31), and each of outer rings is fixed and coupled to each inner circumferential surface of each of the expanded diameter portions (31*a*) to enable the rotary member (31) to be rotatably coupled to the support rod (20).

The first support portion (40) is fixed and coupled to an outer circumferential surface of the other end portion of the support rod (20) corresponding to an inner end of the wrap roll (10), is supported by the inner end of the wrap roll (10) to enable the wrap roll (10) to be fixed to the support rod (20), and includes a first support body (41) and the first insertion parts (42).

The first support body (41) includes a first support plate (41*a*) and a fixed tube body (41*b*).

The first support plate (41*a*) is a disc-shaped member and has one surface which serves to support the paper tube (11) of the wrap roll (10).

The fixed tube body (41*b*) extends from the center of one surface of the first support plate (41*a*) toward the wrap roll (10) and is fixed and coupled to an outer circumferential surface of the support bar (21) to enable the first support portion (40) to be fixed and coupled to the outer circumferential surface of the support bar (21).

The first insertion parts (42) are formed to protrude toward the wrap roll (10) along a circumferential direction of the fixed tube body (41*b*) on the one surface of the first support plate (41*a*) separated from the fixed tube body (41*b*) by a predetermined distance and are formed at multiple positions at regular intervals from a virtual center of the fixed tube body (41*b*) toward the outer side.

The first insertion parts (42) are inserted into the insertion hole (11*a*) formed in the paper tube (11) of the wrap roll (10), and a plurality of the first insertion parts are formed as described above. Hence, various wrap rolls (10) including respective paper tubes (11) having different diameters can be used.

The second support portion (50) is detachably coupled to the male thread (22*a*) formed on the fastening bar (22), is supported by an outer end of the wrap roll (10) to enable the outer end of the wrap roll (10) to be fixed to the fastening bar (22), and includes a second support body (51) and the second insertion parts (52).

The second support body (51) includes a second support plate (51*a*) and an extension tube body (51*b*).

The second support plate (51*a*) is a plate-shaped member having a certain thickness, has one side which is supported by the paper tube (11) of the wrap roll (10) and a fastening hole (51*aa*) formed at a center thereof. In addition, an inner circumferential surface of the fastening hole (51*aa*) has a female thread (51*ab*) formed to be fastened to the male thread (22*a*) of the fastening bar (22).

The extension tube body (51*b*) provides a space to which the second rotary grip portion (60), which will be described below, is rotatably coupled. The extension tube body extends from the other surface of the second support plate (51*a*) corresponding to a circumference of the fastening hole (51*aa*) toward the other end of the support rod (20), and a first lock step (51*ba*) is formed to project from a circumference of the extended end portion along an outward direction.

The second insertion parts (52) are formed to project toward the wrap roll (10) along the circumferential direction of the fastening hole (51*aa*) on the one surface of the second support plate (51*a*) separated at a predetermined distance from the fastening hole (51*aa*) and are formed at a plurality of positions separated at regular intervals from a virtual center of the fastening hole (51*aa*) along the outer direction.

The second insertion parts (52) are formed at positions corresponding to the first insertion parts (42) and are inserted into the insertion hole (11*a*) formed in the paper tube (11) of the wrap roll (10), and a plurality of second insertion parts (52) are formed as described above. Hence, various wrap rolls (10) including respective paper tubes (11) having different diameters can be used.

The second rotary grip portion (60) is rotatably coupled to one side of the second support portion (50) to provide a grip region for a worker and includes a rotary body (61) and a protection cap (62).

The rotary body (61) includes a rotary plate (61*a*) and a rotary tube body (61*b*).

The rotary plate (61*a*) has a through-hole (61*aa*) formed at the center thereof and a grip groove (61*ab*) sunk toward the one end of the support rod (20) along an edge circumference of the other surface, is coupled to the extension tube body (51*b*) of the second support body (51) through the through-hole (61*aa*), and is provided such that the one surface of the rotary plate is supported by the other surface of the second support plate (51*a*).

Here, the grip groove (61*ab*) formed in the rotary plate (61*a*) can provide a grip region that can be easily gripped by a worker.

The rotary tube body (61*b*) extends toward the other end of the support rod (20) from the other surface of the rotary plate (61*a*) corresponding to a circumference of the through-hole (61*aa*) and has second lock steps (61*ba*) which are locked and coupled to a lower portion of the first lock step (51*ba*) of the extension tube body (51*b*) on both sides of an inner circumferential surface facing an extended end portion of the rotary tube body (61*b*).

The second lock steps (61*ba*) of the rotary tube body (61*b*) described above are locked and coupled to the lower portion of the first lock step (51*ba*) of the extension tube body (51*b*) to prevent the rotary tube body (61*b*) from being separated from the extension tube body (51*b*), thereby enabling the second rotary grip portion (60) to be rotatably coupled to the second support portion (50).

The protection cap (62) is formed in a cap shape opened at the lower part thereof, and a lower end of the protection cap is coupled to an extended end of the rotary tube body (61*b*). In this manner, the protection cap (62) is provided to cover the fastening bar (22) formed at the other end of the support rod (20).

The protection cap (62) has grip holes (62*a*) formed on both opposing sides such that the fastening bar (22) is gripped to restrict rotation of the support rod (20).

This protection cap (62) not only provides a grip region which is easily gripped by a worker, but also enables the worker to grip the outer surface of the fastening bar (22) through the grip holes (62*a*), thereby serving to selectively control rotation of the support rod (20).

As described above, the manual wrapping apparatus (1) according to the embodiment of the present invention includes the first rotary grip portion (30) and the second rotary grip portion (60), so that the worker can rotate the support rod (20) in a state of gripping the first rotary grip portion (30) and the second rotary grip portion (60). Hence, it is possible to not only prevent a worker's glove from being caught into wrapping in a wrapping process, but also there is no risk of releasing the second support portion (50) from the fastening state in the wrapping process to cause the wrap roll (10) to be released from a fixed state thereof.

In addition, since the present invention can selectively control the rotation of the support rod (20) through the grip holes (62*a*) formed in the second rotary grip portion (60), tension can be easily added to the wrap during the wrapping work process.

Moreover, according to the present invention, the protection cap (62) of the second rotary grip portion (60) is provided to cover the fastening bar (22) of the support rod (20) to prevent the fastening bar (22) of the support rod (20) from being worn, and even if the protection cap (62) is worn due to frequent contact with the ground, only the rotary grip portion (60) can be easily replaced and used, thereby significantly reducing maintenance costs.

FIGS. 6A to 6D are views for illustrating movement of wrapping a wrapping target object by using the manual wrapping apparatus according to the embodiment of the present invention.

Hereinafter, with reference to the drawings, a process of wrapping a wrapping target object loaded on a pallet from a lower end part to an upper end part by using the manual wrapping apparatus according to the embodiment of the present invention will be described as an example.

Figure 6A:
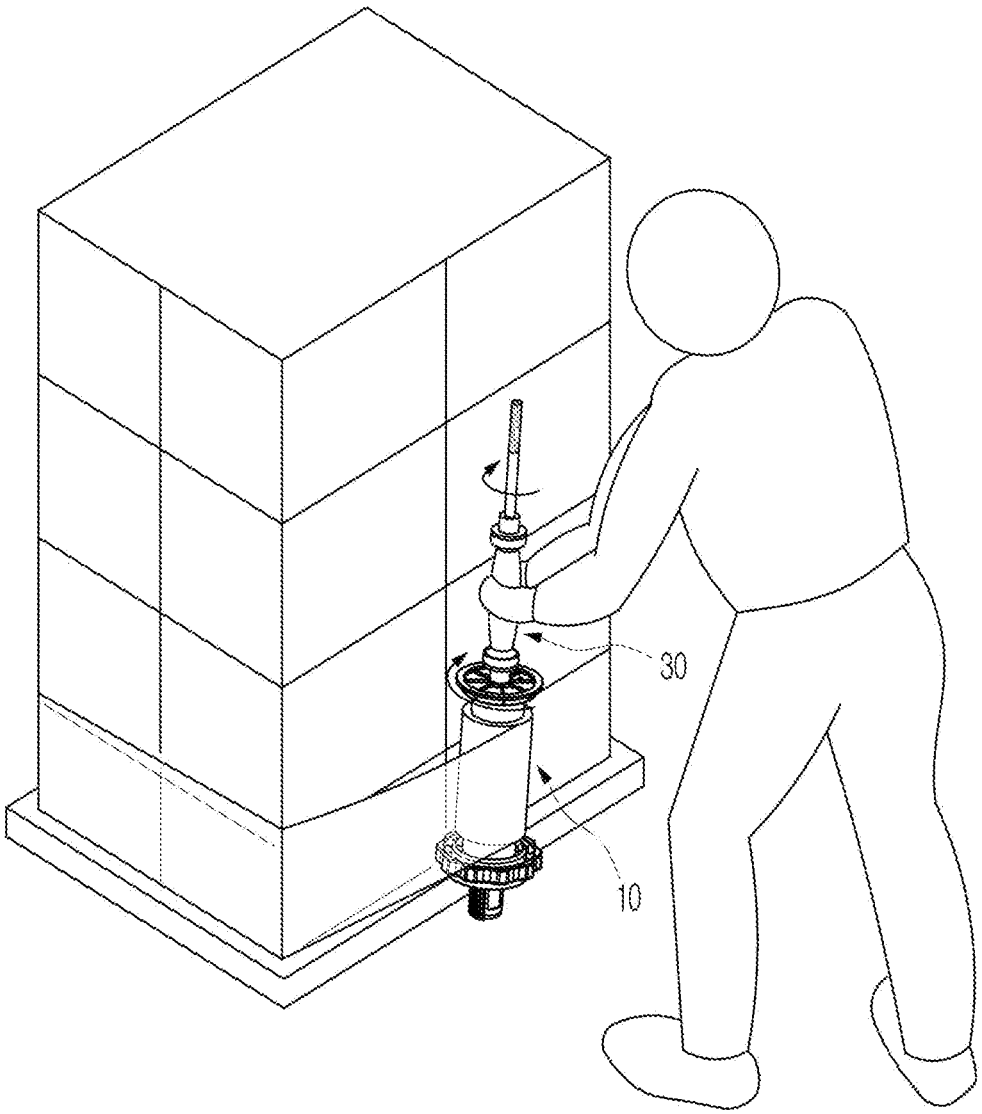
FIGS. 6A to 6D are views for illustrating movement of wrapping a wrapping target object by using the manual wrapping apparatus according to the embodiment of the present invention.

First, an end of wrap wound around the wrap roll (10) is attached to one side of the lower end part of the wrapping target object loaded on the pallet, and as illustrated in FIG. 6A, when the worker moves in a direction in which the wrapping target object is wrapped in a state of gripping the first rotary grip portion (30) in both hands, the support rod (20) coupled to the wrap roll (10) rotates relatively with respect to the first rotary grip portion (30). Hence, the wrap wound around the wrap roll (10) is unwound, and the wrapping target object is wrapped.

Figure 6B:
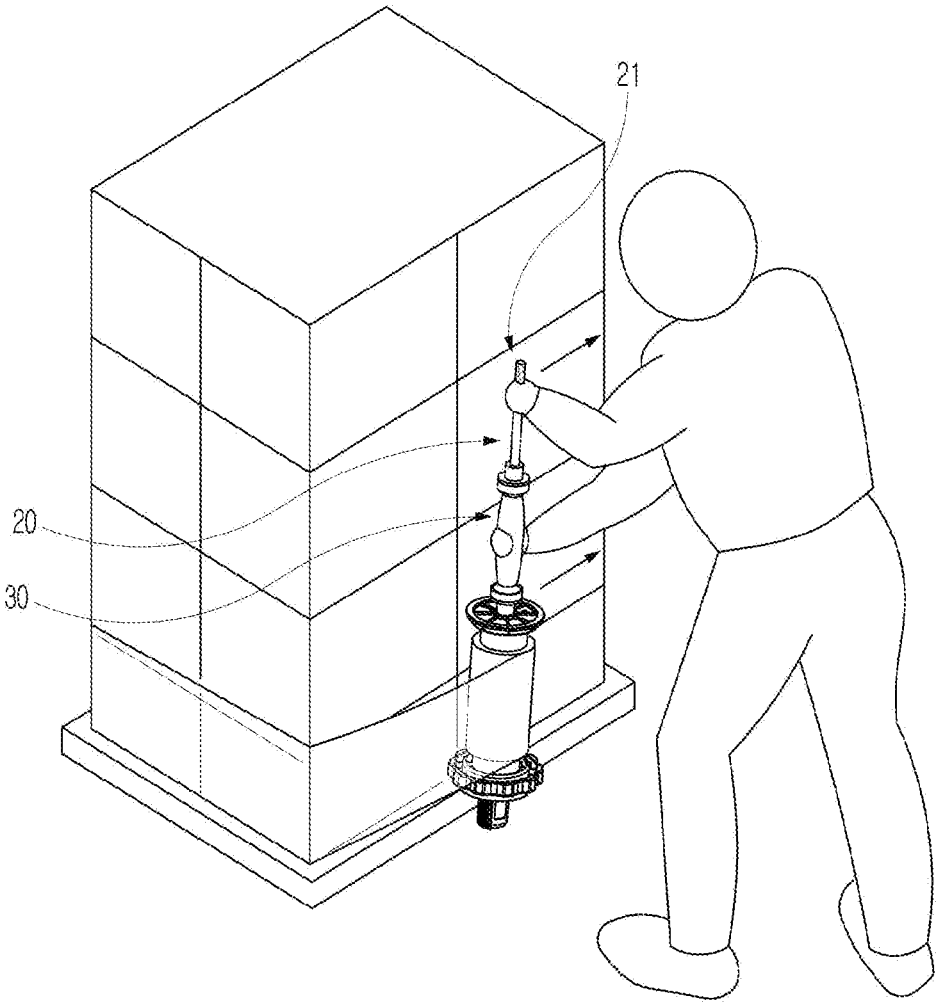

At this time, in order to firmly wrap the wrapping target object, sufficient tension needs to be added to the wrap. In a case of attempting to add tension to the wrap, as illustrated in FIG. 6B, the worker grips the first rotary grip portion (30) in one hand and grips the fixed grip portion (21*a*) in the other hand to restrict the rotation of the support rod (20). In this state, force is applied in the wrapping direction to add tension to the wrap and firmly wrap the wrapping target object.

As described above, in the present invention, in the process of wrapping the lower end part of the wrapping target object loaded on the pallet, the protection cap (62) of the second rotary grip portion (60) provided to cover the other end of the support rod (20) is frequently brought into contact with the ground, and a wear problem may occur. In this case, according to the present invention, it is possible to solve the problem by simply replacing only the second rotary grip portion (60), thereby significantly reducing maintenance costs.

Figure 6C:
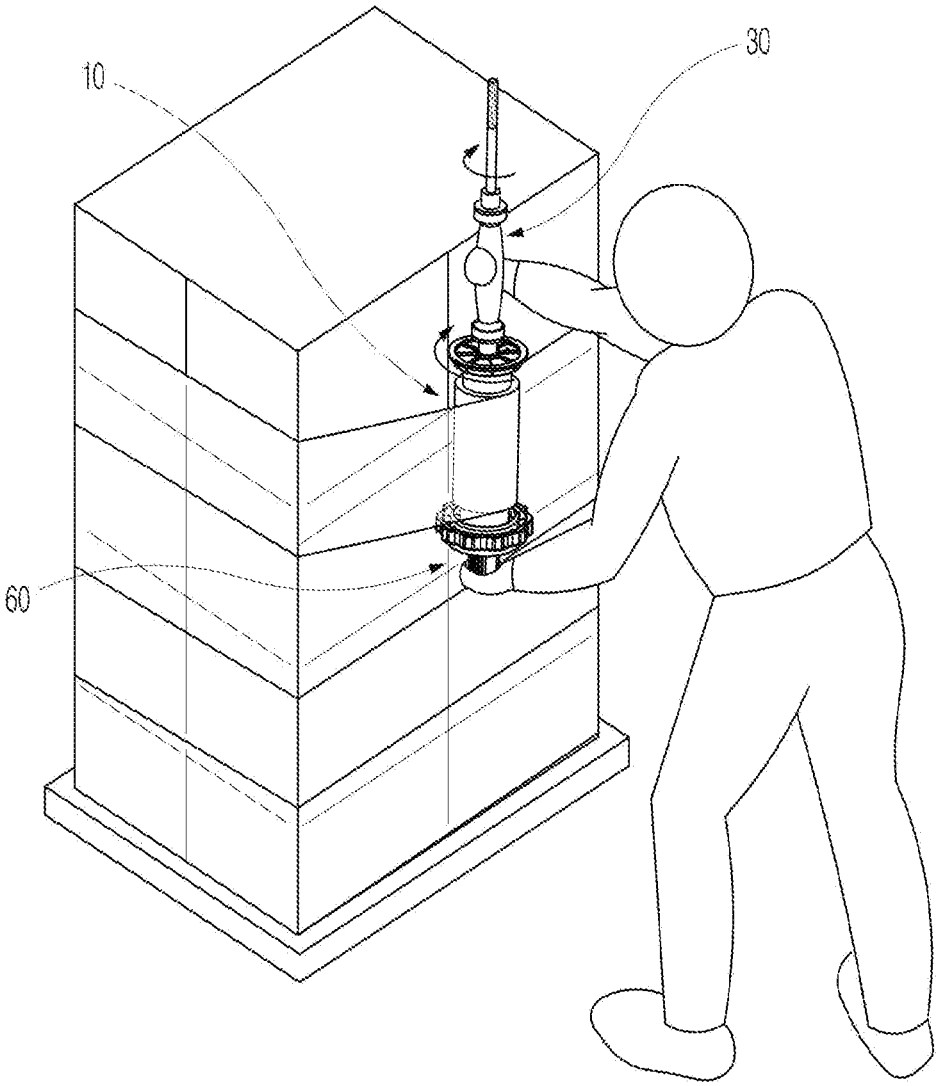

In the case of wrapping the upper end part of the wrapping target object loaded on the pallet as the wrapping work process progresses, when a position of the wrap roll (10) moves upward, as illustrated in FIG. 6C, the worker moves in the direction in which the wrapping target object is wrapped in a state of griping the first rotary grip portion (30) in one hand and gripping the second rotary grip portion (60) in the other hand, the support rod (20) coupled to the wrap roll (10) rotates relatively with respect to the first rotary grip portion (30) and the second rotary grip portion (60). Hence, the wrap wound around the wrap roll (10) is unwound, and the wrapping target object is wrapped.

Figure 6D:
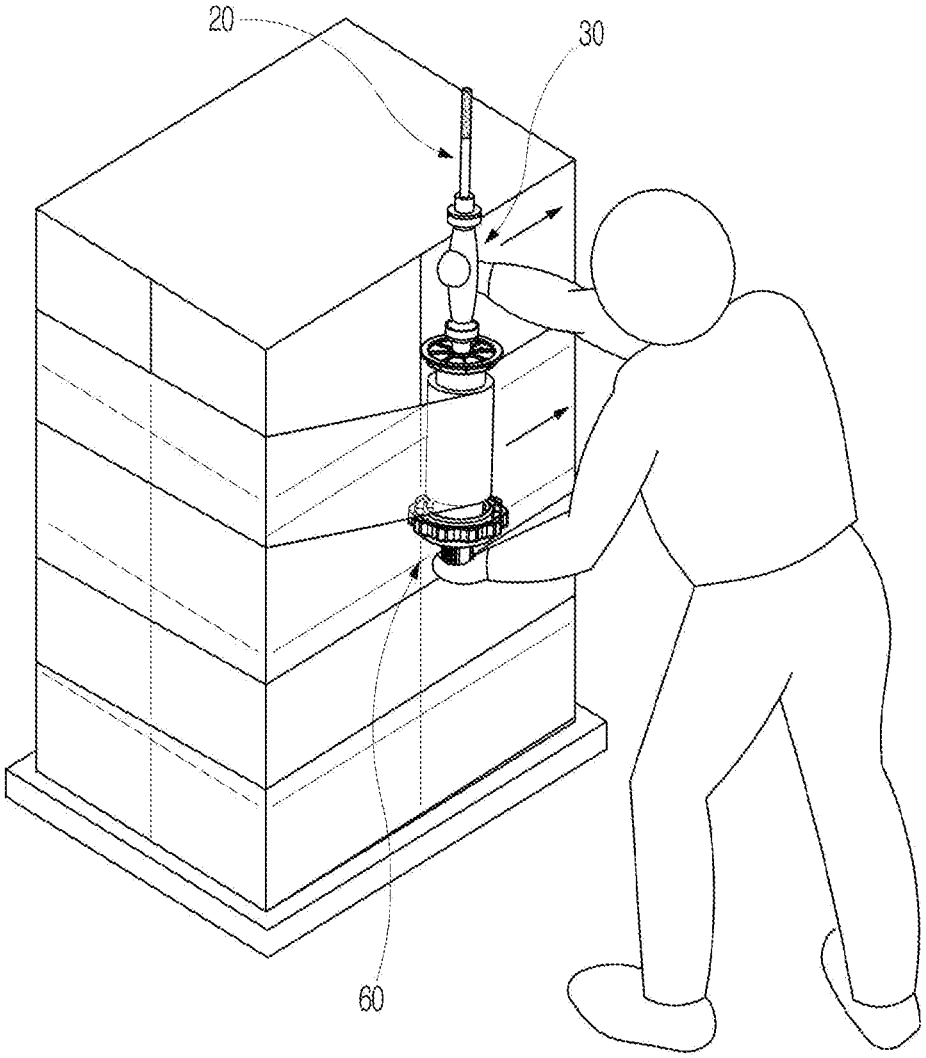

At this time, in the case where the worker adds tension to the wrap, the fastening bar of the support rod (20) is gripped through the grip hole (not illustrated) formed in the second rotary grip portion (60) with the hand gripping the second rotary grip portion (60) such that the rotation of the support rod (20) is restricted. In this state, as illustrated in FIG. 6D, force is applied to the wrap in the wrapping direction to add tension to the wrap and firmly wrap the wrapping target object.

As described above, in the present invention, in the process of wrapping the upper end part of the wrapping target object loaded on the pallet, the position of the wrap roll (10) is moved upward, and thus the worker can more easily grip the manual wrapping apparatus (1) by gripping the first rotary grip portion (30) in one hand and gripping the second rotary grip portion (60) in the other hand.

In addition, in the present invention, in the process of performing the wrapping work, the second support portion (50) rotates together with the support rod (20) that rotates relatively with respect to the first rotary grip portion (30) and the second rotary grip portion (60), and thus there is no risk of releasing the second support portion (50) from the fastening state to cause the wrap roll to be released from the fixed state thereof.

According to the present invention as described above, the structure of the manual wrapping apparatus is improved to prevent the problems of wrapping with a worker's glove caught into the wrapping in a process of wrapping multiple layers of packs and packaging boxes stacked on a pallet or a wrap roll being released from a fixing state thereof but also enables maintenance costs to be significantly reduced by improving a structure of a manual wrapping apparatus.

While the present invention has been described with respect to the specific embodiments, it will be apparent to those skilled in the art that various changes and modifications may be made without departing from the spirit and scope of the invention as defined in the following claims.

What is claimed is:

1. A manual wrapping apparatus comprising:

a wrap roll including wrap which is wound around an outer surface of a paper tube;

a support rod which has a fixed grip portion formed at one end and on which the wrap roll is mounted at the other end portion;

a first rotary grip portion that is rotatably provided on one side of an outer surface of the support rod;

a first support portion that is fixed and coupled to the one side of the outer surface of the support rod corresponding to an inner end of the wrap roll and is supported by the inner end of the wrap roll;

a second support portion that is detachably coupled to the one side of the outer surface of the support rod corresponding to an outer end of the wrap roll and is supported by the outer end of the wrap roll; and a second rotary grip portion that is rotatably coupled to one side of the second support portion;

wherein the second rotary grip portion includes:

a rotary body that is rotatably coupled to the one side of the second support portion; and a protection cap that extends from one side of the rotary body toward the other end portion of the support rod and covers the other end portion of the support rod.

2. The manual wrapping apparatus according to claim 1, wherein the rotary body has a grip groove formed at the other side of the rotary body, the grip groove being sunk toward the one end portion of the support rod.

3. The manual wrapping apparatus according to claim 1, wherein the protection cap has a grip hole which is formed at one side of the protection cap to restrict rotational movement of the support rod.

4. The manual wrapping apparatus according to claim 1, wherein the first support portion and the second support portion have, respectively, a first support body and a second support body which are supported by the inner end and outer end of the wrap roll, respectively, and first insertion parts and second insertion parts which are formed to project from the first support body and the second support body toward the wrap roll and are inserted into the paper tube of the wrap roll, and wherein the first insertion parts and the second insertion parts are formed at multiple positions to be separated at regular intervals along an outer direction from centers of the first support body and the second support body.

* * * * *